United States Patent [19]

Lautenschlaeger, Jr.

[11] 3,952,364

[45] Apr. 27, 1976

[54] MOUNTING PLATE FOR FURNITURE HINGES

[75] Inventor: Karl Lautenschlaeger, Jr., Reinheim, Odenwald, Germany

[73] Assignee: Karl Lautenschlaeger KG, Germany

[22] Filed: Oct. 31, 1973

[21] Appl. No.: 411,282

[30] Foreign Application Priority Data

Oct. 31, 1972 Germany ..... 2253370

[52] U.S. Cl. ..... 16/1 R; 16/163; 16/128 R

[51] Int. Cl.[2] ..... A47G 1/10; E05D 3/06

[58] Field of Search ..... 16/149, 129, 1, 181, 16/163; 248/200 R, 188.2, 188.8, 188.9; 339/246; 220/142 B; 215/47; 403/3, 4

[56] References Cited

UNITED STATES PATENTS

| | | | |
|---|---|---|---|
| 1,002,373 | 9/1911 | DeLancey | 16/149 |
| 1,899,699 | 2/1933 | Kusterle | 248/188.8 |
| 1,936,109 | 11/1933 | Frank | 403/3 |
| 2,902,794 | 9/1959 | Ehrgott | 248/188.9 |
| 3,224,035 | 12/1965 | Heinee | 16/163 |
| 3,476,671 | 11/1969 | Petty | 215/47 X |
| 3,586,306 | 6/1971 | Reece et al. | 248/188.2 |
| 3,659,738 | 5/1972 | Friedmann | 220/42 B |
| 3,664,541 | 5/1972 | Ruskin | 220/42 B |
| 3,772,735 | 11/1973 | Lautenschlaeger | 16/129 |

*Primary Examiner*—James T. McCall
*Assistant Examiner*—Peter A. Aschenbrenner
*Attorney, Agent, or Firm*—Hill, Gross, Simpson, Van Santen, Steadman, Chiara & Simpson

[57] ABSTRACT

This invention relates to a mounting plate for furniture hinges, whereby the supporting arm of the furniture hinge is U-shaped and of varying width. For this purpose, the mounting plate is embodied in such a way that it comprises at least two step-shaped mounting shoulders extending along its two longitudinal margins and adapted to receive the open end of the U-shape of the supporting arm. Hereby, a fairly wide supporting arm will rest upon the lower step-shaped mounting shoulder, while a fairly narrow supporting arm will rest upon one of the higher supporting shoulders. Thereby, the supporting arm is prevented from movement in a direction other than along the longitudinal base plate, and a keyhole-shaped opening in the supporting arm allows an adjustment in this direction.

2 Claims, 7 Drawing Figures

FIG. 1
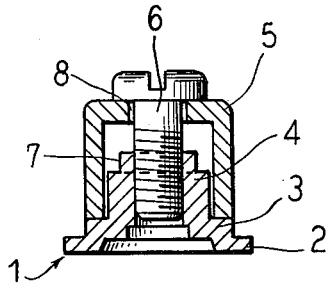
FIG. 5
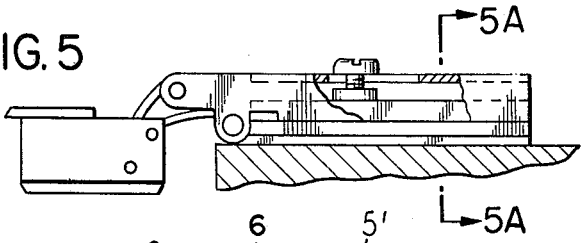
FIG. 5A
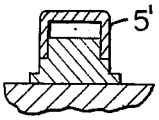
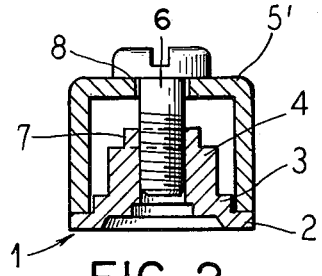
FIG. 2
FIG. 3
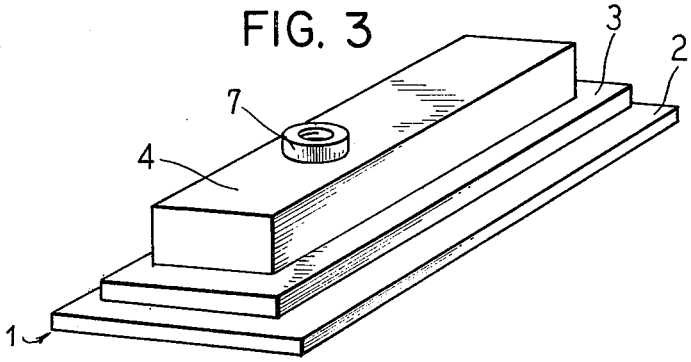
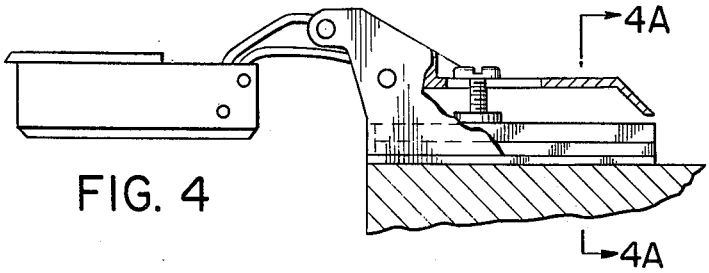
FIG. 4
FIG. 4A
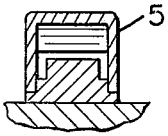

MOUNTING PLATE FOR FURNITURE HINGES

BACKGROUND OF THE INVENTION

This invention relates to mounting plates as they are used for mounting various prefabricated furniture hinges. They are applied to the furniture piece and they receive the supporting arm of the furniture hinge which is usually applied thereon with the help of a screw.

However, in spite of the fact that there do exist several standard sizes of these furniture hinges, there is the need for a base plate which is able to receive all these sizes. It is now common to produce different mounting plates for each differently dimensioned supporting arm. A mounting plate which can be used with several types of hinges will reduce prices and facilitate the production. It is also advantageous for the furniture producer since he will need less space for the storage of these mounting plates, and it will also be possible for him to decide for using a different type of furniture hinge after he has already applied the mounting plate. In addition, hinges of different dimensions are often applied to one single furniture piece, depending upon the size of the individual doors. It is clear that the mounting process becomes much easier if only one type of mounting plate is used at all these fitting points of the supporting furniture wall. In addition, errors will be excluded which may occur if a wrong mounting plate is applied to a furniture piece.

It also happens in practice that a furniture piece has been produced with one type of door, while the user decides to change it to another type of door. The change from, for instance, a wooden door to a glass door would presently require an exchange of the mounting plates which does not only require unnecessary work but which might also damage the supporting wall. The mounting plate according to this invention avoids all these inconvenient or damaging factors.

SUMMARY OF THE INVENTION

A prior art mounting plate for mounting U-shaped supporting arms of furniture hinges of various widths is provided with at least two step-shaped mounting shoulders extending along its longitudinal margins, allowing supporting arms of varying widths to be mounted securely upon this mounting plate. In addition, the screw for attaching the supporting arms may be provided with sufficient thread length by means of an elevation upon the uppermost step-shaped mounting shoulder.

All objects, features and advantages of the invention will be readily apparent from the following description thereof, taken in conjunction with the accompanying drawings, although modifications and variations may be effected without departing from the spirit and scope of the novel concepts of the disclosure.

BRIEF DESCRIPTION OF THE DRAWINGS

FIG. 1 is a partially sectional view through an embodiment provided with a narrow supporting arm;

FIG. 2 is a similar view, whereby the supporting arm is a wide one;

FIG. 3 is a perspective view of the mounting arm by itself;

FIGS. 4 and 4A illustrate a relatively large hinge having a wide U-shaped supporting arm and supported on a mounting plate embodying the invention herein, and FIGS. 5 and 5A illustrate a relatively small hinge having a narrow U-shaped supporting arm and supported on a mounting plate embodying the invention herein.

DESCRIPTION OF THE PREFERRED EMBODIMENT OF THE INVENTION

As shown FIG. 1, the mounting plate, which has been generally denoted by 1, comprises a longitudinal base plate 2 which is attached to the furniture piece and which has step-shaped mounting shoulders 3 and 4 extending along its two longitudinal margins. In the case of FIG. 1, a narrow U-shaped supporting arm 5 is applied to the mounting plate, and it contacts the mounting shoulders 3 and 4, whereby the mounting shoulder 4 serves to hold the supporting arm in place, while the mounting shoulder 3 supports the supporting arm 5. A screw 6 serves for detaching the supporting arm to the mounting plate 1. In order to provide the required length of thread for this screw, an additional circular elevation 7 has been provided upon the uppermost mounting shoulder 4. This is shown in particular in FIG. 3.

Thereby, the supporting arm 5 is secured against fittings in a direction transverse to the direction of the mounting plate 1, while it can be shifted in the longitudinal direction of this mounting plate in view of the fact that a keyhole-shaped opening 8 is provided in the supporting arm 5 for the screw 6, as this is known in the prior art, whereby the screw head is introduced through the wide part of the keyhole while the narrow part allows a longitudinal shifting and thus an exact adjustment in the longitudinal direction.

As opposed to this, FIG. 2 shows an arrangement whereby a supporting arm 5' of a larger width has been used. It can be seen that this wider supporting arm 5' is secured by the lower supporting shoulder 3 in cooperation with the base plate 2.

This form of the invention described hereinabove presents only one embodiment which has been proven to be simple, practical and effective and, although there may be variations and modifications made by those skilled in the art, it is my desire to include these variations and modifications within the scope of my invention as defined in the appended claims.

I claim as my invention:

1. A furniture hinge unit comprising:

a longitudinally extending U-shaped supporting arm of a predetermined width;

a hinge mounting plate for mounting said longitudinally extending U-shaped supporting arm, said mounting plate including, a rigid longitudinal base plate adapted to be secured to a furniture piece and having two substantially parallel longitudinal margins, and a plurality of step-shaped mounting shoulders along said two longitudinal margins of said base plate to accommodate the U-shape supporting arm of said hinge unit as well as U-shaped supporting arms of a different width.

2. A furniture hinge unit comprising:

a longitudinally extending U-shaped supporting arm of a predetermined width;

a hinge mounting plate for mounting said longitudinally extending U-shaped supporting arm, said mounting plate including, a rigid longitudinal base plate adapted to be secured to a furniture piece and having two substantially parallel longitudinal margins, a first step-shaped longitudinally extending mounting shoulder extending along said two longitudinal margins, and at least one further transversely reduced step-shaped longitudinally extending mounting shoulder extending along said margins of said base plate, whereon a U-shaped supporting arm can be mounted on either of said mounting shoulders depending on the width of said supporting arm.

* * * * *